US006616555B2

(12) United States Patent
Bewley

(10) Patent No.: US 6,616,555 B2
(45) Date of Patent: Sep. 9, 2003

(54) ATHLETIC BALL SERVER

(76) Inventor: Carl Dwain Bewley, 2 N. Oaks La., Russellville, AR (US) 72802

( * ) Notice: Subject to any disclaimer, the term of this patent is extended or adjusted under 35 U.S.C. 154(b) by 0 days.

(21) Appl. No.: 09/837,018

(22) Filed: Apr. 18, 2001

(65) Prior Publication Data

US 2002/0155907 A1 Oct. 24, 2002

(51) Int. Cl.[7] ..... A63B 57/00; A63B 69/00; F41B 15/00; F41B 3/04; F41A 9/61

(52) U.S. Cl. ..... 473/451; 473/134; 473/136; 124/7; 124/50; 124/49; 124/1; 124/16

(58) Field of Search ..... 124/45, 50, 51.1, 124/82, 49, 1, 7, 16; 473/137, 451, 449, 132, 134, 136; 273/395; 29/DIG. 73; 209/646, 473; D34/29; 193/35 R

(56) References Cited

U.S. PATENT DOCUMENTS 3,686,888 A * 8/1972 Helton ..... 193/35 R
3,999,753 A 12/1976 Desilets et al.
4,122,822 A 10/1978 Scheiwiller
4,548,407 A 10/1985 Sato
4,830,372 A 5/1989 Outlaw et al.
4,981,299 A * 1/1991 Petrillo ..... 473/136
5,042,802 A 8/1991 Depianta
5,066,010 A 11/1991 Pingston
5,097,985 A 3/1992 Jones
5,421,313 A 6/1995 Strayer
5,665,004 A * 9/1997 Vlahovic ..... 473/134
6,419,589 B1 * 7/2002 Carter ..... 473/134

* cited by examiner

*Primary Examiner*—Paul T. Sewell
*Assistant Examiner*—Mitra Aryanpour
(74) *Attorney, Agent, or Firm*—Frank J. Catalano

(57) ABSTRACT

In an athletic ball server, a collapsible tripod supports an elongated inclined tray containing a linear array of balls. A gate at the low end of the tray cyclically releases balls one at a time from the array to gravity. One edge of a trampoline is pivoted on the tripod. The central portion of the trampoline is aligned to bounce a ball released from the tray. An eye-bolt is connected between the tripod and the trampoline allowing the angular position of the trampoline to be varied. By adjusting the eye-bolt, it is possible to achieve any desired trajectory of the bounced ball from a pop-up or slow pitch trajectory to a ground ball trajectory.

19 Claims, 4 Drawing Sheets

*Fig. 2*
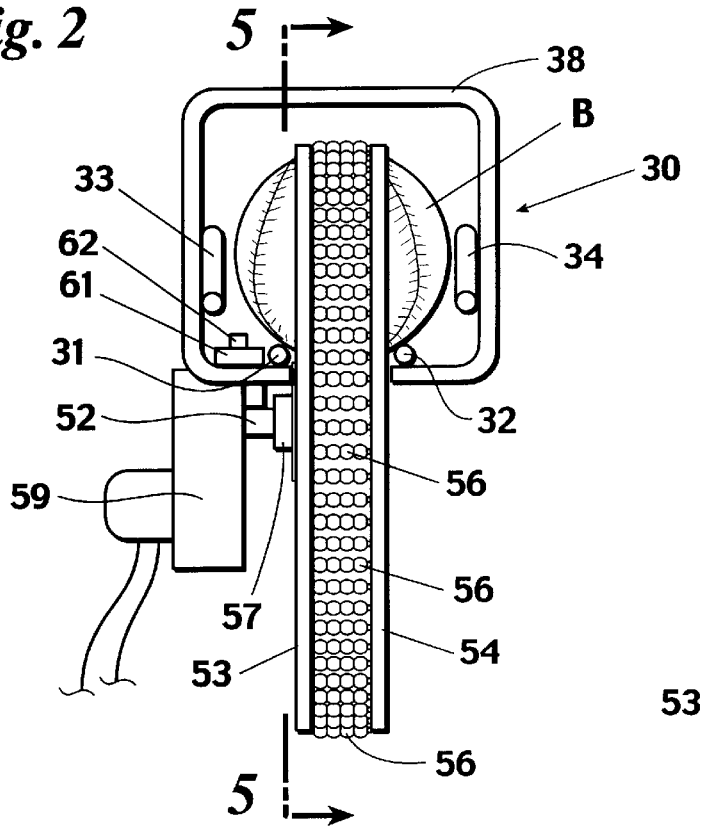
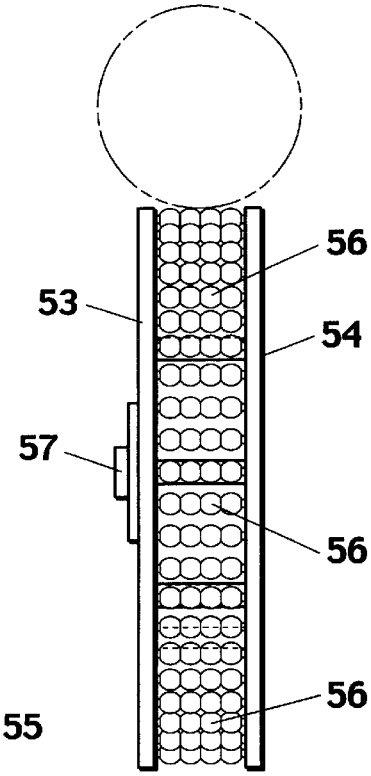
*Fig. 6*
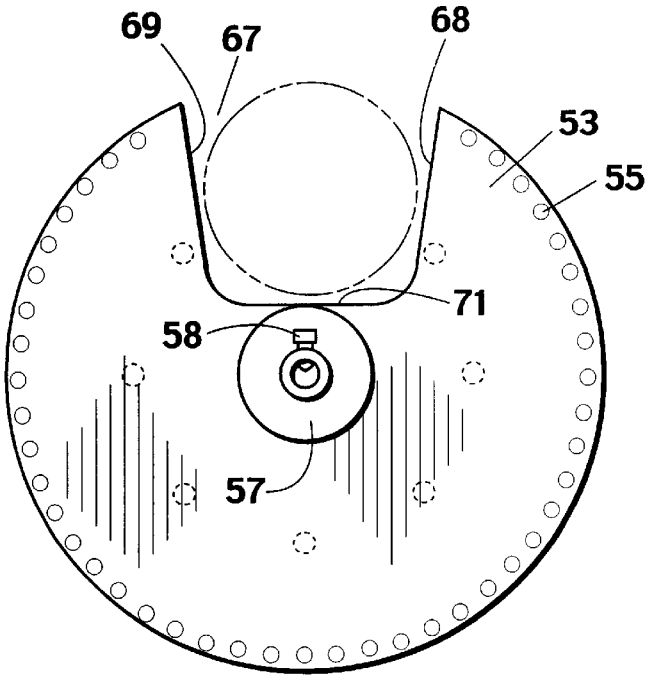
*Fig. 5*

ATHLETIC BALL SERVER

BACKGROUND OF THE INVENTION

This invention relates generally to athletic equipment and more particularly concerns a server for athletic balls such as baseballs and softballs.

A variety of training devices have been developed for serving balls for batting practice. Some merely suspend a ball or support a ball in a fixed location in a strike zone. Such conditions rarely, if ever, occur in competition. Others pitch balls directly toward the batter by use of a lever or chute. This leaves little reaction time, especially for younger athletes. Some guide balls through a vertical chute onto a leaf spring to indirectly bounce the ball toward the batter. While this affords greater reaction time, the loss of downward velocity in the guide chute and minimal resilience afforded by the leaf spring limit the bounce trajectory severely. Consequently, the batter must stand too close to the server to take advantage of the reaction time. Another device uses a trampoline type bounce mechanism instead of a leaf spring to achieve a more vertical bounce, eliminating the need for the batter to track and time the approach of the ball to the hitting zone. This device does not solve the problems of loss of ball velocity in the chute and limited bounce and sacrifices tracking and timing skills which are needed under competitive conditions. Moreover, none of these devices can serve the dual functions of serving balls for batting and fielding practice since none of them provides adequate variably controllable trajectories over a range from slow pitch or pop-up to ground balls.

It is, therefore, an object of this invention to provide a ball server which tosses a ball toward a batter or fielder. Another object of this invention is to provide a ball server which can be used to simulate slow pitch ball trajectories, ground ball trajectories and various trajectories therebetween. A further object of this invention is to provide a ball server which affords reasonable reaction time to the batter or fielder. Yet another object of this invention is to provide a ball server which provides a relatively long distance trajectory in comparison to known bounce devices. It is also an object of this invention to provide a ball server which requires no contact of the ball with chutes or guides during its vertical descent. Still another object of this invention is to provide a ball server which is adjustable to permit a wide range of bounce trajectories. An additional object of this invention is to provide a ball server which automatically cyclically releases balls one at a time without need of an additional signal from the batter, fielder or coach.

SUMMARY OF THE INVENTION

In accordance with the invention, an athletic ball server is provided. The support structure of the server is preferably a collapsible tripod. An elongated inclined tray is mounted atop the structure and supports a linear array of balls. A gate at the low end of the tray cyclically releases balls one at a time from the array to gravity. One edge of a trampoline-like platform is mounted by a pivot to the support structure. A central portion of the platform lies beneath the low end of the tray and is aligned to bounce a ball which has been released. An adjustable linkage, preferably an eye-bolt, is connected between the support structure and the platform. The linkage allows the angular position of the plane defined by the pivotal axis of the pivot and the distal edge of the platform to be varied. By adjusting the length of the linkage, it is possible to achieve any desired trajectory of the bounced ball from a pop-up or slow pitch trajectory to a ground ball trajectory.

Preferably, the platform includes a frame with an elastic member stretched tautly on the frame. Most preferably, the elastic member is a plurality of rubber bands arranged in two weaves of transverse layers with a first weave being a first sequential alternating warp and weft assembly of rubber bands beginning at any corner of the frame and a second weave being a second sequential alternating assembly of warp and weft rubber bands beginning at any corner of the frame. The use of rubber bands provides a highly resilient platform with easily replaceable resilient components. Best angular control has been achieved using a second adjustable linkage, also preferably an eye-bolt, spaced apart from the first adjustable linkage and connected between the support structure and the platform. The first and second linkages are cooperable for setting the angular position of the platform to achieve the desired trajectory of the bounced ball.

The resilience or bounce of the platform can be maximized by third and fourth adjustable linkages connected in spaced apart relationship between the support structure and the distal edge of the platform. The length of the third and fourth linkages is adjusted to pull the distal edge of the platform downwardly and tauten the platform against the resistance offered by the first and second adjustable linkages. The third and fourth adjustable linkages may each also be turnbuckles.

The gate consists of a wheel mounted proximate the low end of the tray for rotation on a shaft which is transverse to the elongated tray. The wheel has its circumference aligned with and obstructing travel of the linear array of balls in the tray. The circumference has a slot for receiving balls one at a time from the linear array and for releasing the received ball at the low end of the tray as the wheel rotates. A drive motor is connected to the shaft and a power source energizes the drive motor to rotate the wheel at a known angular velocity so as to serve a desired number of balls per minute. Preferably, the wheel is formed from a pair of circular discs symmetrically spaced on the shaft from a plane aligned with the linear array of balls. A plurality of bearings are mounted for rotation on a plurality of horizontal pins connected between the discs and angularly displaced along the circumference. At least one of the bearings is always in contact with the lowest ball of the array not received in the slot during rotation of the wheel. This minimizes the resistance applied to the wheel by the balls, thus increasing the life of the motor and power source and decreasing the noise level of the server during operation. Most preferably, each of the bearings is itself a plurality of beads disposed on each of the pins.

Preferably, the tray is formed by a pair of rods spaced apart to support the array of balls therebetween with the wheel disposed between the rods. The shaft has its axis positioned below the rods and the slot has a depth such that the ball received in the slot maintains contact with the rods rather than the bottom of the slot. Thus, the wheel truly serves as a gate rather than a carriage. This reduces the weight driven by the motor and allows the balls to continue in a free-rolling pattern on the rods even while they are in the slot, resulting in a more smoothly operating, long life server.

BRIEF DESCRIPTION OF THE DRAWINGS

Other objects and advantages of the invention will become apparent upon reading the following detailed description and upon reference to the drawings in which:

FIG. 2 is a front elevation view taken along the line 2—2 of FIG. 1;

FIG. 5 is a side elevation view taken along the line 5—5 of FIG. 2;

FIG. 6 is a top plan view illustrating the position of a ball on the gate wheel bearings;

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
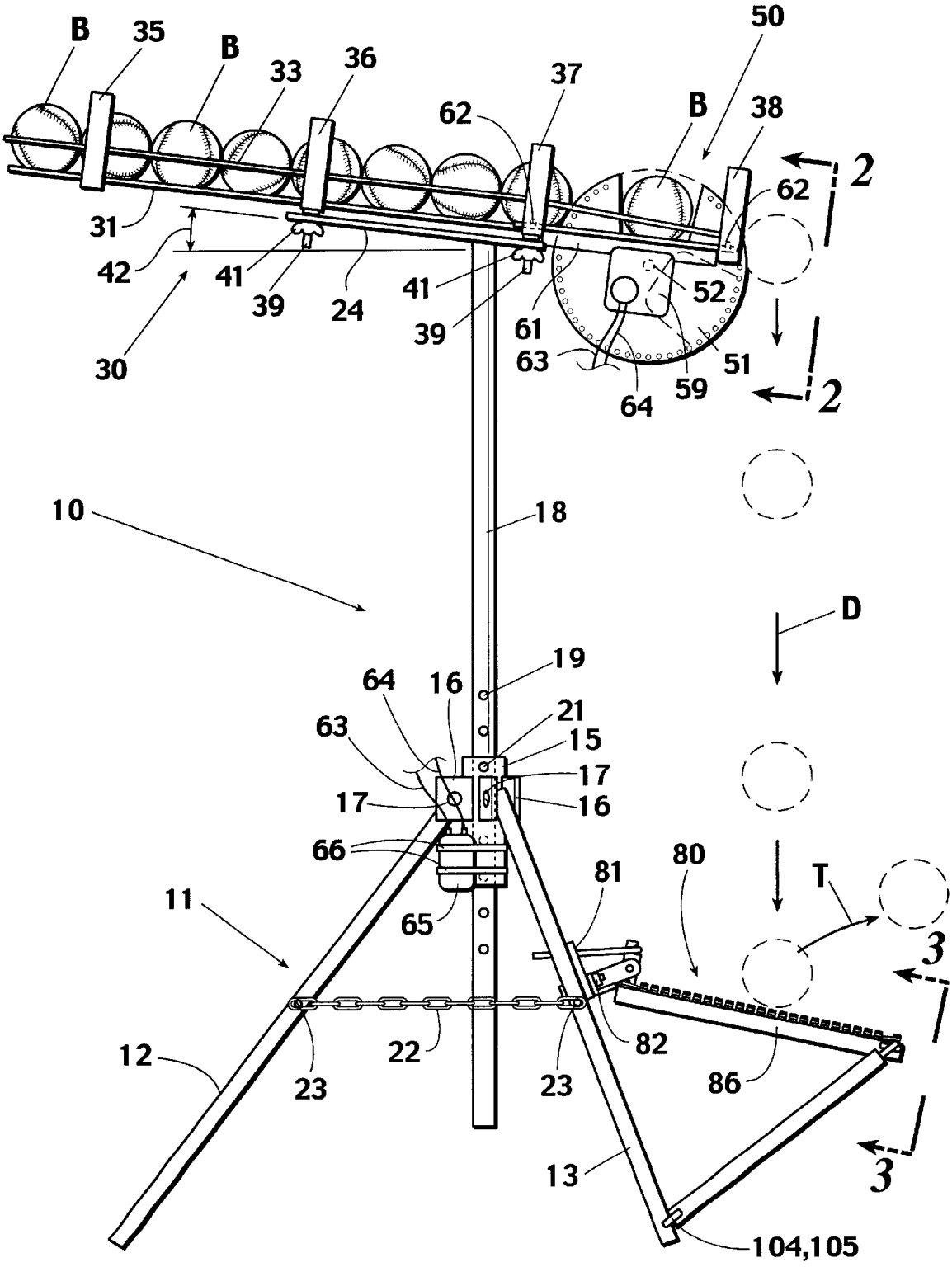
FIG. 1 is a side elevation view of a preferred embodiment of the ball server.

Turning first to FIG. 1, an athletic ball server for serving balls to an athlete is illustrated. The server illustrated serves softballs B to a hitter or fielder but could be adapted to serve baseballs, volleyballs, basketballs, soccer balls or virtually any round athletic ball by dimensional modification of various components to accommodate the diameter of the type of ball served. The server consists generally of a structure 10 supporting a tray 30 storing an array of balls B. A gate 50 cyclically releases the balls B one at a time from the tray 30. The balls B fall freely from the tray 30 under the force of gravity onto a trampoline-like platform 80. The orientation and tension of the platform 80 can be adjusted to bounce or launch the balls B on a desired trajectory to the athlete.

Continuing to look at FIG. 1, the preferred support structure 10 includes a collapsible tripod 11. Defining the drop path D of the balls B to be at the front of the server, the tripod 11 has a back leg 12 and a pair of front legs 13 and 14 which are symmetrically positioned in relation to the drop path D. The upper ends of the legs 12, 13 and 14 are each pivotally connected to a sleeve 15 using devices 16 and pins 17. An upright member 18, preferably a length of pipe, is slidably disposed in the sleeve 15. A vertical array of holes 19 are spaced apart through the wall of the upright 18 in alignment with a hole in the sleeve 15. Thus, the height of the support structure 10 can be selected by sliding the upright 18 in the sleeve to align one of the holes 19 in the upright 18 with the hole in the sleeve 15 and inserting a pin 21 into the aligned holes to lock the upright 18 in relation to the sleeve 15. Preferably, each leg 12, 13 or 14 is connected to the other two legs by chains 22 engaged on lugs 23 to limit the rotational motion of the legs 12, 13 and 14 in the clevices 16 and provide maximum stability of the open tripod 11. A plate 24, elongated in a direction taken and slightly downwardly inclined from rear to front of the server, is fixed to the top of the upright 18. The legs 13, 14 and 15 could be telescoped if it is desired to make the collapsed assembly more compact.

Looking now at FIGS. 1 and 2, the preferred structure of the elongated tray 30 will be understood. A pair of ball support rods 31 and 32 extend parallel to each other and are horizontally spaced apart to support a ball B seated on the rods 31 and 32. A pair of guide rods 33 and 34 are horizontally spaced apart at a distance slightly greater than the diameter of the balls B to be served. The guide rods 33 and 34 are vertically positioned above the support rods 31 and 32 to approximately parallel the centers of the balls B resting on the support rods 31 and 32. The rods 31, 32, 33 and 34 are fixed in the above described configuration by high end, high middle, low middle and low end brackets 35, 36, 37 and 38, respectively. The brackets 35, 36, 37 and 38 shown are approximately square tube sections. The support rods 31 and 32 are welded to their inside lower faces. The guide rods 33 and 34 are welded to their inside upright faces. While the brackets shown are square, any shape bracket including circular or elliptical can be used provided the rods 31, 32, 33 and 34 are held in the position described and the brackets do not interfere with the movement of the balls B. The rods 31, 32, 33 and 34 and brackets 35, 36, 37 and 38 form an elongated tray 30 which supports a linear array of balls B riding on the support rods 31 and 32 between the guide rods 33 and 34. As shown, it is preferred that the forward end of the guide rods 33 and 34 between the low middle bracket 37 and low end bracket 38 be inclined downwardly from rear to front of the tray 30 to minimize the possibility of the guide rods 33 and 34 interfering with the function of the gate 50 to be hereinafter described. Preferably, the high and low middle brackets 36 and 37 are provided with downwardly depending bolts 39 which can be inserted into holes provided in the support structure mounting plate 24. Wing nuts 41 secure the tray 30 to the plate 24 atop the support structure 10. As shown, the plate 24, and therefore the tray 30 attached to it, are downwardly inclined from rear to front of the server. An angle of inclination 42 of approximately six degrees has been found to work very efficiently.

Looking at FIGS. 1, 2, 5 and 6, the preferred structure of the gate 50 which cyclically releases the balls B one at a time from the low end of the tray 30 will be understood. The gate 50 includes a wheel 51 which is concentrically mounted on one end of a shaft 52. Preferably, the wheel 51 consists of a pair of disks 53 and 54 held in spaced apart parallel relationship by a plurality of pins or spacers 55. The pins 55 are preferably equally angularly displaced about the perimeter of the disks 53 and 54. Each of the pins 55 supports a rotating plastic bearing or plurality of beads 56. A hub 57 mounted on the outside face of one disk 53 permits the wheel 51 to be engaged to the shaft 52 by set screw 58. The shaft 52 is driven by a drive motor 59. Preferably, the drive motor is mounted beneath a mounting bar 61. The low middle and low end brackets 37 and 38 are each provided with lugs 62 which extend upwardly on one side of the brackets 37 and 38. The wheel 51 is vertically aligned midway between the guide rods 31 and 32 on a plane aligned with the linear array of balls B. The shaft 52 extends along an axis transverse to and below the guide rods 31 and 32. The bar 61 is provided with holes for receiving the upright lugs 62. The gate 50 is installed proximate the low end of the tray 30 by inserting the wheel 51 between the support rods 31 and 32 and seating the bar 61 on the brackets 37 and 38 with the lugs 62 extending into the holes in the bar 61. A pair of leads 63 and 64 extend from the drive motor 59 to a power source such as a 12 volt battery 65. As shown, the battery 65 is fixed to the sleeve 15 on the tripod 11 by a pair of elastic straps 66. For convenience in putting up and taking down the server, alligator clips (not shown) may be provided on the ends of the leads 63 and 64 for connection to the posts of the battery 65. As is best seen in FIG. 2, the bottom wall of the low end bracket 38 has the portion between the support rods 31 and 32 removed to facilitate insertion of the wheel 51 between the rods 31 and 32. In the embodiment of the server shown, dimensioned to accommodate softballs B, the slot in the bracket 38 may be necessary to accommodate the wheel. This is not always the case. For example, if the same server were used to serve baseballs rather than softballs, the diameter of the wheel would be reduced so that the bracket 38 might not intersect the path of the wheel 51.

Figure 8:
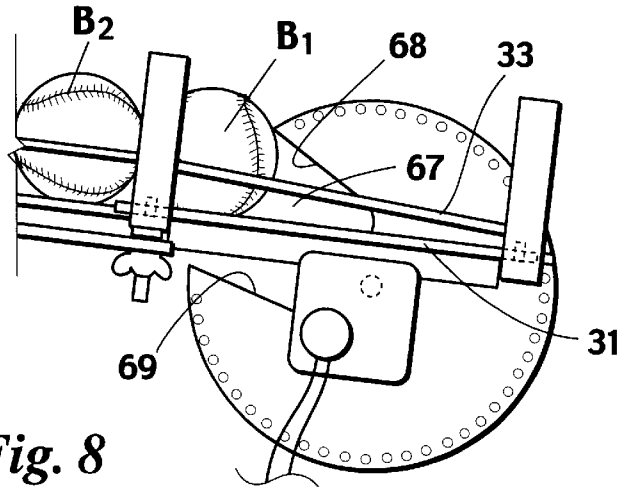
FIGS. 7 through 10 are side elevation views illustrating sequential positions of a ball in a single cycle of the server.
Figure 10:
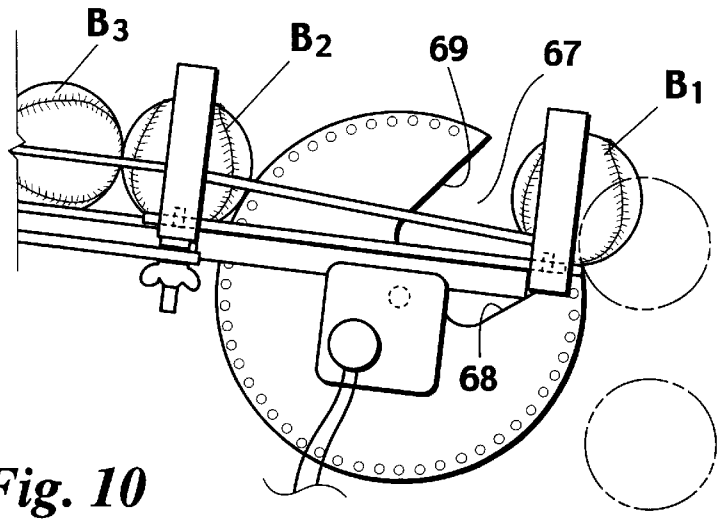
Figure 7:
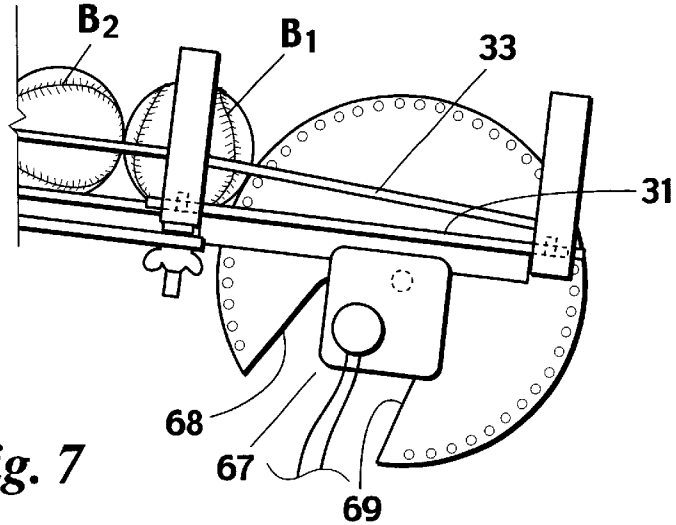
Figure 9:
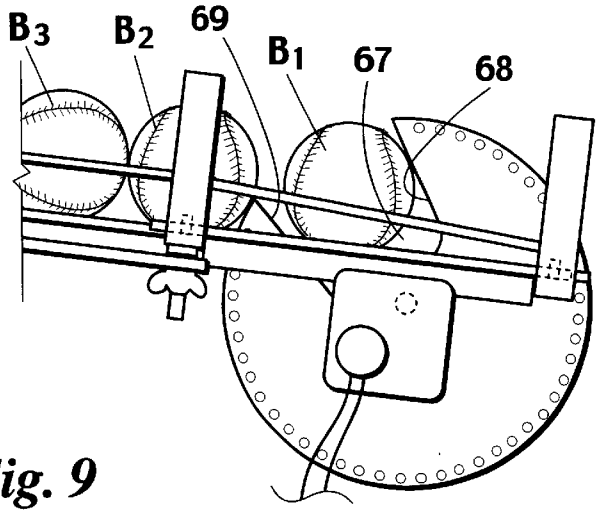

Looking at FIG. 5, each of the disks 53 and 54 is provided with a slot 67 which extends from the circumference of its disk 53 or 54 toward its center. As shown, the slots 67 have leading edges 68, trailing edges 69 and bottoms 71. The distance between the leading and trailing edges 68 and 69 is slightly greater than the diameter of the ball B to be gated so that the ball B can sit freely in the slots 67. The depth of the slots 67 is such that, as can best be seen in FIG. 1, the ball B seated on the support rods 31 and 32 does not contact the bottoms 71 of the slots 67. Assuming the shaft 52 and wheel 51 are being driven by the motor 59 in a clockwise direction as seen in FIG. 1, the operation of the gate 50 can be understood by looking at FIGS. 7–10. In FIG. 7, as the wheel 51 rotates, the ball $B_1$ closest to the wheel 51 rides on the bearings or beads 56. The riding of the ball B on the beads 56 is best exemplified in FIG. 6. The use of the bearings 56, and especially the beads, results in minimum drag on the motor 59. If the ball B is allowed to ride on the disks 52 and 53, the power source 65 is more quickly exhausted, the motor 59 more quickly wears out and the system is much noisier and less efficient in its operation. Therefore, the angular displacement of the pins 55 is coordinated to the diameter of the balls B and the spacing between the discs 53 and 54 so that ball B closest to the wheel 51 and not in the slot 67 always maintains contact with at least one bearing or set of beads 56. Returning to FIG. 7, as the wheel 51 rotates and the ball B rides on the bearings or beads 56, the leading edge 68 of the slot 67 eventually rides past the diametric center of the ball $B_1$ so that, as shown in FIG. 8, the ball $B_1$ begins to roll into the slot 67. During this motion, the ball $B_1$ continues to ride on the support rods 31 and 32 under the influence of the downward incline of the tray 30. As shown in FIG. 9, when the ball $B_1$ is received in the slot 67, the trailing edge 69 of the slot 67 follows behind the ball $B_1$. The circumference of the wheel 51 blocks the next ball $B_2$ from entering the slot 67. The next ball $B_2$ rides on the bearings or beads 56 until the leading edge 68 of the slot 67 completes a rotation to receive the next ball $B_2$. As shown in FIG. 9, the ball $B_1$ received in the slot 67 continues to roll under the influence of the inclination of the tray 30 on the rods 31 and 32. The only contact between the wheel 51 and the ball B is at the leading edge 68 of the slot 67. As seen in FIG. 10, when the leading edge 68 of the slot 67 at the circumference of the wheel 51 rotates past the support rods 31 and 32, the ball $B_1$ continues its inclined descent on the rods 31 and 32 until it is released to gravity and begins its vertical fall in the path D illustrated in FIG. 1.

Figure 4:
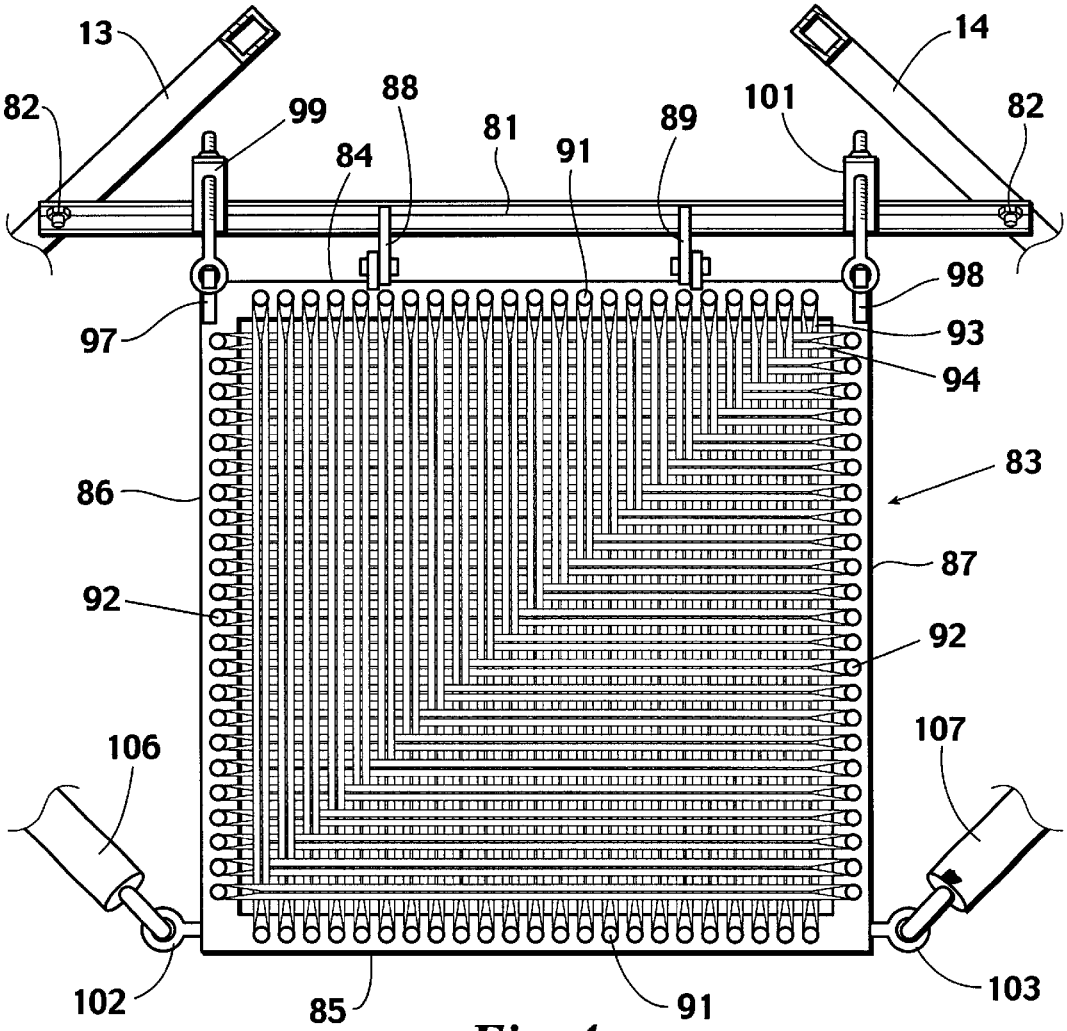
FIG. 4 is a top plan view taken along the line 4—4 of FIG. 3.
Figure 3:
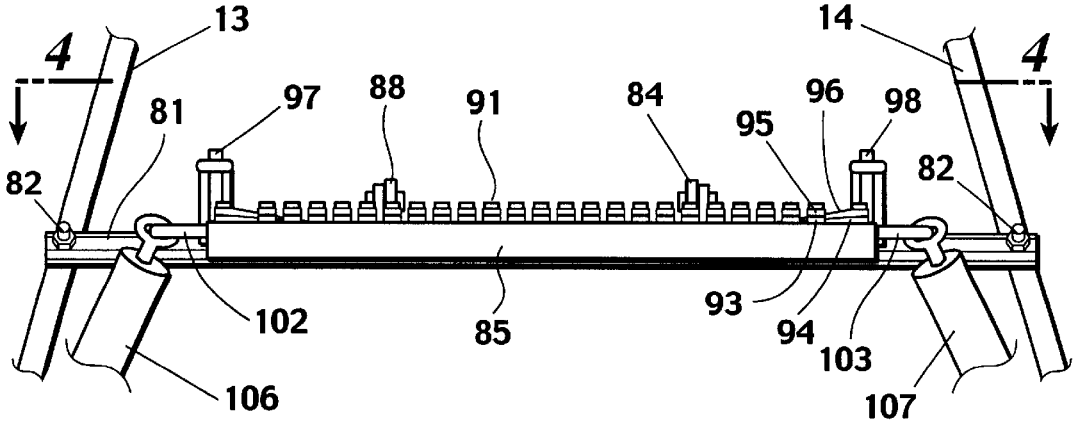
FIG. 3 is a front elevation view taken along the line 3—3 of FIG. 1.

As the ball B falls on the path D, it is intercepted by the trampoline-like platform 80 illustrated in FIGS. 1, 3 and 4. Preferably, the platform 80 is positioned so that the drop path D of the ball B intersects the platform 80 at its central portion. An angle iron 81 or, preferably, a rectangular tube, is detachably bolted 82 across the forward legs 13 and 14 of the tripod 11. As shown, the angle iron 81 is disposed across approximately the mid-point of the legs 13 and 14. The platform 80 has a frame 83 made of channels or preferably, as shown, angle irons in a square configuration with a proximate edge 84 nearest the angle iron 81 bolted to the legs 13 and 14 of the tripod 11 and a distal edge 85 opposite the proximate edge 84. The frame 83 also has side edges 86 and 87 connecting the proximate and distal edges 84 and 85. Pivot hinges 88 and 89 connect the proximate edge 84 of the frame 83 to the angle iron 81 and permit the frame 83 to be angularly adjusted by rotation of the proximate edge 84 about an axis parallel to the angle iron 81. The proximate and distal edges 84 and 85 of the frame 83 have arrays of upright pegs 91 equally and oppositely spaced along their lengths. Similarly, the side edges 86 and 87 have arrays of upright pegs 92 equally and oppositely spaced along their length. Preferably, the pegs 91 and 92 are press fit into holes in the frame 83. The face of the trampoline-like platform 80 is formed by tautly stretching elastic members, preferably rubber bands 93 and 94 across oppositely disposed pegs 91 and 92, respectively. As shown, starting at one corner of the platform 80, rubber bands 93 connecting opposite pins 91 are alternately mounted with transverse rubber bands 94 connecting opposite pins 92 in a sequential alternating warp and weft assembly, as is best seen in FIG. 4. As can best be seen in FIG. 3, a first weave of rubber bands 93 and 94 as above described overlayed by a second weave of rubber bands 95 and 96 similarly woven has been found to be an excellent launch pad. A platform 80 made with rubber bands has been found to be more effective in producing desired trajectories than elastic sheets. Furthermore, rubber bands are more easily handled and manipulated than elastic sheets and individual rubber bands can readily be replaced rather than an entire sheet. Rubber bands having a higher rubber content perform better than those with lower rubber content.

In order to permit selection of the trajectory T of the ball B from the platform, the proximate edge 84 of the frame 83 is provided with a pair of hooks 97 and 98. eye-bolts 99 and 101 mounted on the angle iron 81 engage the hooks 97 and 98. Thus, by adjusting the length of the eye-bolts 99 and 101, the angular position of the platform 80 the axis of the hinges 88 and 89 can be varied. To further control and maximize the bounce of the platform 80, the distal corners of the platform 80 and the lower ends of the tripod legs 13 and 14 are provided with eyes 102 and 103 and 104 and 105, respectively. A pair of turnbuckles 106 and 107 connected between corresponding distal and tripod leg eyes 102 and 104 and 103 and 105, respectively, allow the tension of the platform 80 to be adjusted. That is, as the lengths of the turnbuckles 106 and 107 are shortened, the stress applied to the distal edge 85 of the platform 80 pulls the distal edge 85 downwardly to tauten the platform 80 against resistance from the angle setting eye-bolts 99 and 101 and increase the resiliency of the trampoline, resulting in maximum launch distances.

A prototype server for ten men's or twelve women's softballs or fourteen baseballs used a tray 30 approximately forty-eight inches long, a wheel 51 approximately 7½ inches in diameter with forty-two bearing pins 55 between discs 53 and 54 spaced one inch apart and an approximately 14 inch by 14 inch platform 80 with 23 pins on each edge. The support structure 10 was adjustable to permit the low end of the tray 30 to be set at between four and one-half and seven and one-half feet above ground. The slot 67 was sized to suit the ball used. To change from softballs to baseballs, for example, the wheel 51 was changed using the set screws 58. The same wheel 51 was used for either men's or women's softballs. A twelve volt, 12 rpm single speed motor with a six volt battery served six balls per minute. By proper coordination of the motor and power source, any desired service rate could be achieved.

The entire assembly can quickly be broken down for transport. The alligator clipped leads 63 and 64 are disconnected from the battery 65. The motor 59 and wheel 51 are removed from the tray 30 by disengaging the bar 51 from the lugs 62. The wing nuts 41 are removed and the tray 30 separated from the support plate 24. The bolts 82 are removed to disengage the platform 80 from the tripod 11.

The pin 21 is positioned to shorten the support structure 10 and the tripod 11 collapsed. The entire disassembled server can be carried in an approximately 60"×16"×12" bag or case.

Thus, it is apparent that there has been provided, in accordance with the invention, an athletic ball server that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. An athletic ball server comprising a support structure, an elongated inclined tray mounted atop said support structure for supporting a linear array of athletic balls, a gate mounted at a low end of said tray for cyclically releasing balls of the array one at a time from said low end of said tray to gravity, a trampoline-like platform mounted by a pivot at one edge thereof to said support structure with a central portion of said platform beneath said low end of said tray and aligned to bounce a ball released to free-fall by gravity from said low end of said tray onto said platform and an adjustable linkage connected between said support structure and said platform for setting an angular position of a plane of said platform defined by a pivotal axis of said pivot and a distal edge of said platform to achieve a desired trajectory of a bounced ball therefrom.

2. A ball server according to claim 1, said platform comprising a frame and an elastic member stretched tautly on said frame.

3. A ball server according to claim 2, said elastic member comprising a plurality of rubber bands arranged in a first weave.

4. A ball server according to claim 3, said rubber bands being arranged in transverse layers.

5. A ball server according to claim 4, said first weave being a result of a sequential alternating warp and weft assembly of said rubber bands beginning at any corner of said frame.

6. A ball server according to claim 5, said member further comprising a second weave layered over said first weave, said second weave being a result of a second sequential alternating assembly of warp and weft rubber bands beginning at any corner of said frame.

7. A ball server according to claim 1, said adjustable linkage comprising an eye-bolt.

8. An athletic ball server comprising a support structure, an elongated inclined tray mounted atop said support structure for supporting a linear array of athletic balls, a gate for cyclically releasing balls of the array one at a time from a low end of said tray to gravity, a trampoline-like platform mounted by a pivot at one edge thereof to said support structure with a central portion of said platform beneath said low end of said tray and aligned to bounce a ball released to gravity from said low end of said tray and first and second spaced apart adjustable linkages connected between said support structure and said platform, said first and second linkages being cooperable for setting an angular position of said platform to achieve a desired trajectory of a bounced ball therefrom.

9. A ball server according to claim 8, said first and second adjustable linkages each being an eye-bolt.

10. A ball server according to claim 8, said platform further having third and fourth adjustable linkages connected in spaced apart relationship between said support structure and said distal edge of said platform for pulling said distal edge downwardly to tauten said platform against resistance from said first and second adjustable linkages.

11. A ball server according to claim 10, said third and fourth adjustable linkages each being a turnbuckle.

12. An athletic ball server comprising a support structure, an elongated inclined tray mounted atop said support structure for supporting a linear array of athletic balls, a wheel mounted proximate a low end of said tray for rotation on a shaft transverse to said elongated tray, said wheel having a circumference aligned with and obstructing travel of the linear array of balls, said circumference having a slot for receiving balls one at a time therein from the linear array and for releasing the received ball at said low end of said tray as said wheel rotates, a drive motor connected to said shaft, a power source for energizing said drive motor to cyclically release balls of the array one at a time from said low end of said tray to gravity, a trampoline-like platform mounted by a pivot at one edge thereof to said support structure with a central portion of said platform beneath said low end of said tray and aligned to bounce a ball released to gravity from said low end of said tray and an adjustable linkage connected between said support structure and said platform for setting an angular position of a plane of said platform defined by a pivotal axis of said pivot and a distal edge of said platform to achieve a desired trajectory of a bounced ball therefrom.

13. A ball server according to claim 12, said wheel comprising a pair of circular discs symmetrically spaced on said shaft from a plane aligned with the linear array of balls.

14. A ball server according to claim 13 further comprising a plurality of bearings mounted for rotation on a plurality of pins connected between said discs and angularly displaced along said circumference such that at least one of said bearings is in contact with a lowest ball of the array not received in said slot during rotation of said wheel.

15. A ball server according to claim 14, each of said bearings comprising a plurality of beads disposed on each of said pins.

16. A ball server according to claim 12, said tray comprising a pair of rods spaced apart for supporting the array of balls therebetween.

17. A ball server according to claim 16, said wheel being disposed between said rods.

18. A ball server according to claim 17, said shaft having an axis positioned below said rods and said slot having a depth such that a ball received in said slot maintains contact with said rods.

19. An athletic ball server comprising a support structure, an elongated inclined tray mounted atop said support structure for supporting a linear array of athletic balls, a gate mounted at a low end of said tray, a trampoline-like platform aligned on a mechanically unimpeded path beneath said gate to receive and bounce a ball released to free-fall by gravity from said gate and angularly oriented to impart a trajectory to a ball bounced thereon away from said platform and means for activating said gate to continuously, automatically, cyclically release balls of the array one at a time from said gate to free-fall by gravity onto said platform.

* * * * *